US009869452B2

(12) United States Patent
Onac et al.

(10) Patent No.: US 9,869,452 B2
(45) Date of Patent: Jan. 16, 2018

(54) OPTICAL ELEMENT FOR OBTAINING A SKYLIGHT APPEARANCE AND A LUMINAIRE

(71) Applicant: PHILIPS LIGHTING HOLDING B.V., Eindhoven (NL)

(72) Inventors: Gabriel-Eugen Onac, Veldhoven (NL); Marcellinus Petrus Carolus Michael Krijn, Eindhoven (NL); Jochen Renaat Van Gheluwe, Lommel (BE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 38 days.

(21) Appl. No.: 14/893,210

(22) PCT Filed: May 20, 2014

(86) PCT No.: PCT/EP2014/060271

§ 371 (c)(1),
(2) Date: Nov. 23, 2015

(87) PCT Pub. No.: WO2014/191250

PCT Pub. Date: Dec. 4, 2014

(65) Prior Publication Data

US 2016/0102843 A1 Apr. 14, 2016

(30) Foreign Application Priority Data

May 30, 2013 (EP) ..... 13169890

(51) Int. Cl.
*F21V 9/02* (2006.01)
*F21V 11/06* (2006.01)

(52) U.S. Cl.
CPC ..... *F21V 11/06* (2013.01); *F21V 9/02* (2013.01)

(58) Field of Classification Search
CPC ..... F21V 11/06; F21V 9/02; F21W 2121/008
See application file for complete search history.

(56) References Cited

U.S. PATENT DOCUMENTS 2,904,673 A * 9/1959 Guth, Sr. ..... F21V 5/00 362/330
3,124,311 A * 3/1964 Kruger ..... F21V 11/00 359/591

(Continued)

FOREIGN PATENT DOCUMENTS

WO 2008050288 A1 5/2008
WO 2008146229 A1 12/2008
WO 2012140579 A2 10/2012

*Primary Examiner* — Peggy Neils

(57) ABSTRACT

An optical element for use in front of a light source for obtaining a skylight appearance, and a luminaire are provided. The optical element comprising a plurality of light transmitting cells in a raster structure, a diffuser and an edge wall. A light source emits light towards the raster structure. The raster structure collimates a part of the light and transmits a further part of the light in a predetermined spectral range. White light and colored light that is transmitted by the raster structure may impinge upon the side wall of the optical element. One face of the side wall is a region of specular reflectivity and will reflect the light that impinges upon it back into the chamber that is formed by the cooperation of the raster structure, the diffuser and the edge wall. Light exits the optical element through the diffuser.

9 Claims, 11 Drawing Sheets

(56) References Cited

U.S. PATENT DOCUMENTS

| | | | | |
|---|---|---|---|---|
| 4,747,028 | A * | 5/1988 | Piotrovsky | F21V 11/06 362/224 |
| 7,837,361 | B2 * | 11/2010 | Santoro | F21S 11/00 359/599 |
| 8,128,273 | B2 * | 3/2012 | Pijlman | G02B 6/005 362/607 |
| 2016/0102843 | A1 * | 4/2016 | Onac | F21V 11/06 362/343 |

* cited by examiner

OPTICAL ELEMENT FOR OBTAINING A SKYLIGHT APPEARANCE AND A LUMINAIRE

CROSS-REFERENCE TO PRIOR APPLICATIONS

This application is the U.S. National Phase application under 35 U.S.C. §371 of International Application No. PCT/EP2014/060271, filed on May 20, 2014, which claims the benefit of European Patent Application No. 13169890.4, filed on May 30, 2013. These applications are hereby incorporated by reference herein.

FIELD OF THE INVENTION

The invention relates to optical elements which are used to create a skylight appearance.

BACKGROUND OF THE INVENTION

Published patent application WO 2012/140579 A2 discloses an optical element for use in front of a light source for obtaining a skylight appearance, a lighting system and a luminaire. Light from the light source is transmitted into a light transmitting cell. The cell has a light transmitting channel with a wall. The wall is at least partly reflective and/or transmissive in a predefined spectral range to obtain a blue light emission.

SUMMARY OF THE INVENTION

It is an object of the invention to provide a more fully immersive skylight appearance. It has therefore been recognized by the inventors that it is possible to further improve upon the uniformity of light emitted by an optical element such as disclosed in WO 2012/140579 A2.

An optical element for use in front of a light source for obtaining a skylight appearance in accordance with the first aspect of the invention comprises an element light input window and an element light exit window. The optical element comprises a raster structure situated at the element light input window, a diffuser situated at the element light exit window opposite of the raster structure, and an edge wall extending between the raster structure and the diffuser. The raster structure, the diffuser and the edge wall together define a chamber. The raster structure comprises a plurality of light transmitting cells, each light transmitting cell comprising:

- a light transmitting channel for collimating a part of light emitted by the light source,
- a light input window at a first side of the light transmitting channel for receiving light from the light source,
- a light exit window for emitting light, at least a part of the light exit window being arranged at a second side of the light transmitting channel opposite to the first side, and
- a wall interposed between said light input window and said part of the light exit window, the wall enclosing the light transmitting channel, at least a part of the wall being transmissive in a predefined spectral range for obtaining a colored light emission at relatively large light emission angles with respect to a normal to the part of said light exit window. Additionally, a surface of the edge wall arranged perpendicular to the raster structure is specularly reflective for specularly reflecting light emitted from the raster structure and impinging on said surface of the edge wall towards said diffuser.

An embodiment of the luminaire described in WO 2012/140579 A2 provides a skylight appearance by making use of a raster structure in combination with a weak diffuser. This combination renders the desired color over angle effect, with white light emitted downwards and increasingly saturated blue light at large angles. However this effect is perturbed at the edges due to the limited size of the raster and the side walls between raster and diffuser. Scattering of light on the edge wall(s) of the luminaire changes the original light distribution coming from the raster. This change in light distribution affects the uniformity of light emitted towards a viewer in intensity and color, resulting in visible edge effects.

The inventors have realized that using a specular reflecting wall at the edge wall(s), in the space between the raster and the diffuser, or extending from diffuser to beyond the raster, i.e. including the raster, greatly improves the uniformity of the light emitted. For the daylight effect it is important that the angular light distribution is maintained the same. At the same time, to achieve spatial uniformity of the brightness, the light intensity needs to be the same in the center and at the edges of the luminaire. Both these can be achieved by using a specular reflecting surface which must be installed perpendicularly to the raster plane. The perpendicular edge wall(s) are parallel with the symmetry axes of both the white and, in the case of daytime daylight, blue light angular distributions, folding back these distributions as if the light would come from a continued raster beyond the edge wall(s).

In other words, by having perpendicular (to the raster plane) mirror walls on the edge wall(s) of the luminaire the raster is mirrored and therefore together with the resulting virtual raster images one creates the effect of an infinite raster structure.

Thus, both the brightness uniformity and the color over angle effect are preserved from edge to edge, enhancing the impression of a skylight.

The importance of daylight for living beings has widely been recognized. Daylight influences, for example, the well-being, the physical and mental health, and/or the productivity of people. Within buildings it is not always possible to have daylight available in every space of the building and artificial daylight light sources are widely used in such spaces. Known artificial daylight light sources mainly focus on the parameters of light intensity, color temperature and/or color point, color distribution and slow dynamics for simulating a day/night rhythm. It is the insight of the inventors that a more homogenous light with the desired color over angle effect, (that is to say white light emitted in a collimated manner with increasingly saturated colored light at large viewing angles) is made possible by the inclusion of a specularly reflective region within the optical element. The optical element according to the invention generates a skylight appearance according to this characteristic.

Light which is received via the light input window at least partly passes through the light transmitting channel towards the light exit window without impinging on the wall. The part which is transmitted through the optical element without impinging on the wall is, compared to the light distribution emitted by the light source, a distribution with light emission angles which are relatively small with respect to a normal to the light input window. This part of the light of the light source becomes a collimated light beam. The collimated light beam has light with the spectrum of the light source, and only the angle of the angular light emissions distribution has been changed compared to the original light emitted by the light source.

Another part of the light which is received via the light input window impinges on the wall and is transmitted through the wall. At least the part of the wall, where the light impinges on or through which the light is transmitted, is transmissive in a predefined spectral range. The predefined spectral range is chosen such that a color of the light which is transmitted through the wall changes towards colored light such as for example a more blue light, a more red light or a more orange light. The color can be chosen to provide various daylight effects such as for example a sunrise or a sunset. Preferably the spectral range chosen changes the color of the light transmitted through the wall towards light in the blue region of the spectrum. In other words, the part of the wall being transmissive in a predefined spectral range absorbs light of colors complementary to the color chosen for the transmissive wall. Especially, light rays of the light which impinges on the wall generally have an angle to the normal axis to the light input window which is relatively large and generally larger than the angle of light rays which do not impinge on the wall. The angle, with respect to the normal, of light rays that impinge and which transmitted through the wall is on average relatively large with respect to the normal to the light exit window. Thus, at the light exit window, light of which the color is changed towards the color chosen for the transmissive wall, is emitted at relatively large emission angles, while the light which did not impinge on the wall is collimated and is emitted at relatively small emission angles.

It is to be noted that, if the light source emits light along a relatively large surface, also some light rays traveling at relatively small light emission angles and entering the light transmitting channel close to the wall, impinge on the wall. Thus, on average, the light rays which impinge on the wall are emitted at relatively large light emission angles and, on average, the light rays which are emitted by the light source at relatively small light emission angles do not impinge on the wall.

Consequently, the optical element according to the invention emits through the light exit window a light emission distribution which comprises light which has the characteristics of the light of the light source at relatively small light emission angles, and which comprises light of which the color is changed towards the color chosen for the transmissive wall, at relatively large light emission angles. Especially, if the light source emits substantially white light which has a color point close to the black body line in the CIE color space, The light at relatively low light emission angles is experienced by users as direct sun light, and the light at relatively wide light emission angles is experienced by users as more colored diffuse light which is present in daylight at certain times, such as a sunrise or a sunset. In an alternative embodiment a blue color is chosen for the wall, this means that the light at relatively low emission angles is experienced by users as direct sunlight, and the light at relatively wide light emission angles is experienced by users as more blue diffuse light which is present in daylight. Thus, a skylight appearance is obtained.

The optical element comprises a raster structure, a diffuser and an edge wall extending between the raster structure and the diffuser. The raster structure comprises a plurality of light transmitting cells, each light transmitting cell comprising a light transmitting channel, a light input window, a light exit window and a wall interposed between the light input window and the light exit window. This wall is at least partly transmissive in a predefined spectral range.

The edge wall that extends between the raster structure and the diffuser has a surface that is specularly reflective for specularly reflecting light emitted from the raster structure and impinging on the surface of the edge wall towards the diffuser.

The edge wall may also extend in the portion that is interposed between the raster structure and the diffuser. This extended portion extends into a chamber formed by the raster structure, diffuser and the edge wall and is specularly reflective.

The specularly reflective surface may be arranged at a symmetry plane of the raster structure perpendicular to the raster structure. This positioning of the specular reflective surface also gives a viewer an impression of an apparently continuous raster structure.

Thus, the optical element creates a more homogenous skylight effect, and may be placed in front of existing light sources and/or luminaries without altering the light source or the luminaire. Thus, the solution is effective, efficient and relatively cheap.

It is to be noted that the light exit window may be larger than the part that is arranged at the second side, because, if the wall is transparent, a part of the wall through which light is emitted becomes a portion of the light exit window. The part of the light exit window arranged at the second side emits the light of the light source that is collimated and colored light may be emitted through this part as well. If the light exit window also has a part that is not arranged at the second side, through this part at least colored light is emitted.

The optical element comprises a plurality of light transmitting cells and can be used in front of a light source or luminaire which has a relatively large light emitting surface. The different light transmitting cells are distributed over space and receive light of other parts of the light emitting surface of the light source or luminaire. Thus, the skylight appearance may be obtained along a larger surface and, thus, the skylight appearance will be enhanced—skylight is also not a local phenomena. Further, the dimensions of the light transmitting cell strongly influence the collimation of the light of the light source. If the light source is not a point source, the dimensions of the light transmitting cell have to increase as well to obtain the daylight appearance. By placing a plurality of light transmitting cells besides each other, each light transmitting cell receives light from a limited sub-area of the light source, and as such their dimensions may be reduced. Thus, the length of the light transmitting cells can be reduced and a relatively thin layer of light transmitting cells can be applied in front of a light source or luminaire which has a relatively large light emitting surface. Thus, the dimensions of the combination of the light source or luminaire and the optical element remain within acceptable limits.

The plurality of light transmitting cells are arranged in a raster structure. This means that the light transmitting cells are placed together in a regular pattern, that each light transmitting cell has a plurality of neighboring light transmitting cells, that all the light input windows are faced in a specific direction and, consequently, that all light output windows are facing in another direction being an opposite direction of the specific direction, and, thus, that the optical element becomes a layer of adjacent light transmitting cells. The optical element with a raster structure of light transmitting cells provides a uniform light output along a relatively large area, assuming that the light source provides to all light transmitting cells the same type of light. Further, the optical element may be manufactured very efficiently because adjacent light transmitting cells may share their walls: one side of a wall faces towards a first light transmitting cell and the other side faces towards a second light transmitting cell which is adjacent to the first light transmitting cell.

The optical element further comprises a light diffuser, the light diffuser is placed at a limited distance from the light exit window of the light transmitting cell for diffusing the light being emitted through the light exit window. The light diffuser should weakly diffuse the light. The weak light diffuser contributes to a more smooth transition between (white) light which directly originates from the light source and the more colored light, and may result, if used in front of a raster of a plurality of light transmitting cells, into a more uniform light emission and hiding the edges of the light transmitting cell walls.

Note that in cases where a point light source, such as LEDs, without additional optics are used, the diffuser helps to mask the point-like and very bright appearance of the point light source. Also, as the light transmitting channels have transmissive walls, at larger angles the individual point light sources will become hardly visible due to the many reflections and transmissions of the light by the interfaces between the light transmitting channels and the walls. This is a considerable advantage.

According to a second aspect of the invention, a luminaire is provided which comprises the optical element according to the first aspect of the invention.

The luminaire according to the second aspect of the invention provides the same benefits as the optical element according to the first aspect of the invention and has similar embodiments with similar effects as the corresponding embodiments of the optical element.

These and other aspects of the invention are apparent from and will be elucidated with reference to the embodiments described hereinafter.

It will be appreciated by those skilled in the art that two or more of the above-mentioned embodiments, implementations, and/or aspects of the invention may be combined in any way deemed useful.

Modifications and variations of the optical element or the luminaire, which correspond to the described modifications and variations of the optical element, can be carried out by a person skilled in the art on the basis of the present description.

Figure 1:
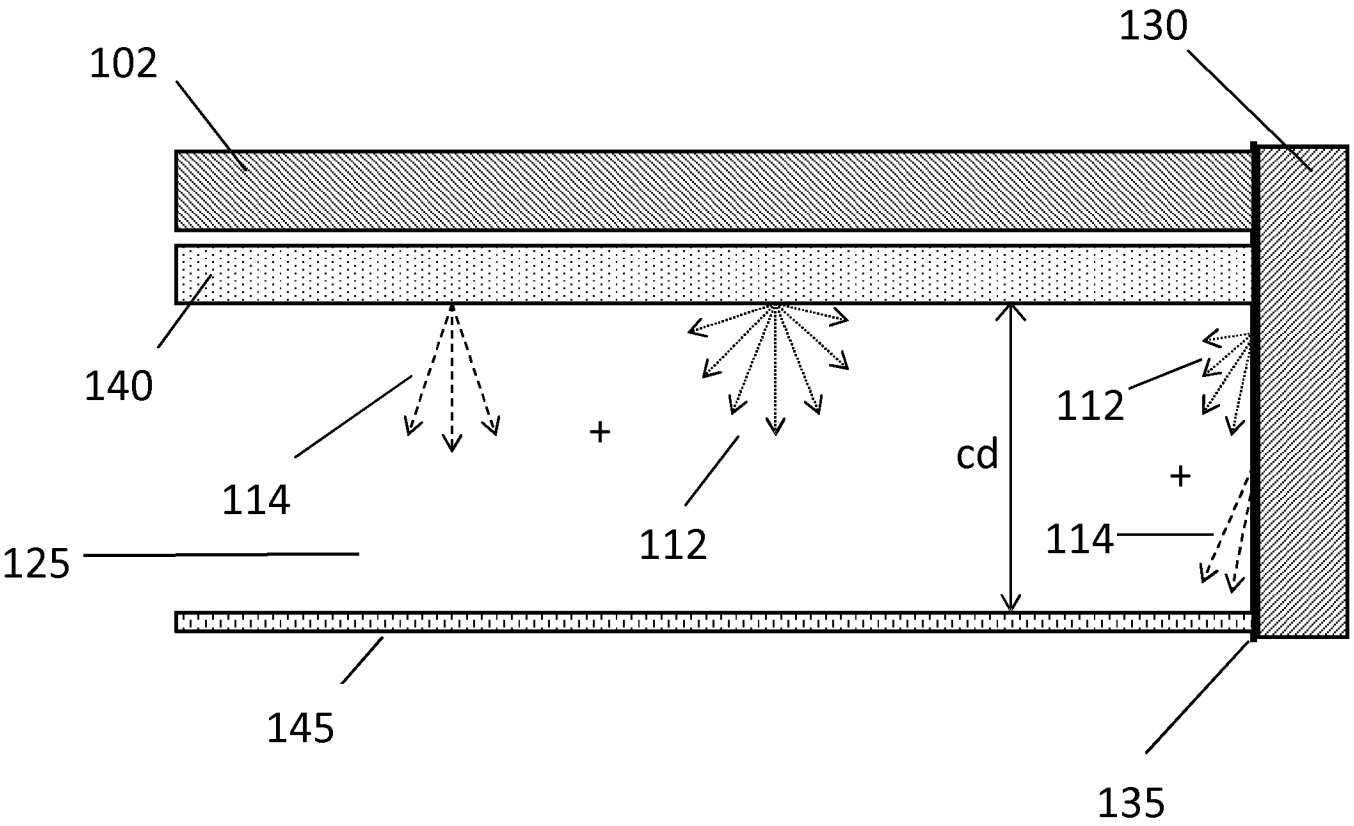
FIG. 1 schematically shows a cross-section of an optical element comprising a raster structure, a diffuser and an edge wall according to the first aspect of the invention, FIG. 2 schematically shows a cross-section of an optical element comprising a plurality of light transmitting cells, FIG. 3*a* schematically shows a cross-section of a light transmitting cell within the optical element, FIG. 3*b* schematically shows another embodiment of a light transmitting cell within the optical element, FIG. 4*a* schematically shows an embodiment of the raster structure comprising a plurality of light transmitting cells, FIG. 4*b* schematically shows another embodiment of the raster structure comprising a plurality of light transmitting cells, FIG. 4*c* schematically shows a preferred embodiment of the raster structure comprising a plurality of light transmitting cells, FIG. 5 schematically shows another embodiment of the optical element comprising a plurality of light transmitting cells in a raster structure, a diffuser and an edge wall, FIG. 6 schematically shows a cross section along a plane parallel to the light input windows of the light transmitting cells. The edge wall is shown as a black line and is positioned adjacent to a row of light transmitting cells. At least a portion of the edge wall is specularly reflective and so the dotted lines show the mirror image obtained, this creates an apparently continuous raster structure.

It should be noted that items denoted by the same reference numerals in different Figures have the same structural features and the same functions, or are the same signals. Where the function and/or structure of such an item have been explained, there is no necessity for repeated explanation thereof in the detailed description.

The figures are purely diagrammatic and not drawn to scale. Particularly for clarity, some dimensions are exaggerated strongly.

DETAILED DESCRIPTION

A first embodiment of an optical element is shown in FIG. 1. The optical element comprising a plurality of light transmitting cells in a raster structure 140, a diffuser 145 and an edge wall 130. A light source 102 emits light towards the raster structure 140.

The raster structure 140 comprises a plurality of light transmitting cells (not shown). Each light transmitting cell comprises a light transmitting channel that collimates part of the light emitted by the light source 140, a light input window, a light exit window, and a wall that is interposed between the light input window and the light exit window. The wall that is interposed between the light input window and the light exit window is transmissive in a predefined spectral range.

Collimated light 114 with the same color as the light source and light 112 that is transmitted through the side walls of the plurality of light transmitting cells exits the raster structure 140 through the light exit windows of the light transmitting cells. The light 112 is emitted in a color that is changed towards the color chosen for the transmissive light transmitting cell wall.

The white light 114 which is emitted by the light source 102 has certain characteristics, like a specific color point in a color space (e.g. the CIE xyz color space) and the light 112 is emitted within a specific angular light emission distribution and colored by transmission through the light transmitting cell walls.

White light 114 and colored light 112 that is transmitted by the raster structure 140 may impinge upon the side wall 130 of the optical element. One face of the side wall 130 is a region of specular reflectivity 135 and will reflect the light that impinges upon it back into the chamber 125 that is formed by the cooperation of the raster structure 140, the diffuser 145 and the edge wall 130.

Light exits the optical element through the diffuser 145, the weak diffusion of the diffusing layer 145 is advantageous to obtain a light emission distribution which has a smooth transition between light 114 which directly originates from the light source 102 and the colored light 112 that is transmitted through the walls of the light transmitting cells.

In an embodiment, the light diffuser increase the full width half maximum (FWHM) angle of an angular light emission distribution being transmitted through the light diffuser not more than 20°.

If the light diffuser diffuses too much, which means that the angle of the angular light distribution is increased too much, the skylight appearance generated by the optical element is cancelled, because the (white) light directly originating from the light source and the more colored light are mixed too much at all light emission angles. Thus, the diffusion should be kept within acceptable limits and thus the maximum increase of the FWHM angle of the angular light distribution is 20°.

The light diffuser may also be an anisotropic diffuser, which means that an increase in the FWHM angle is larger in some directions than in others; e.g. 5° in the x-direction and 10° in the y-direction.

In an embodiment, the light diffuser increase the full width half maximum (FWHM) angle of an angular light distribution being transmitted through the weak light diffuser not more than 10°.

In yet another embodiment, the light diffuser increase the full width half maximum (FWHM) angle of an angular light distribution being transmitted through the weak light diffuser not more than 5°.

Thus, the optical element emits light 114 with the same color point as the light source 102 at relatively small emission angles with respect to the normal to an element light exit window. In an embodiment, the specific color point of the light source 102 is a point in a color space close to a blackbody line of a color space. Direct sunlight has also a color point on or close to the blackbody line. Consequently, if the light source 102 emits light at a color point close to the blackbody line, viewers experience the collimated light beam 114 as direct sunlight. Colored light 112 is also emitted at relatively large light emission angles with respect to the normal to the element light exit window. Such light can be for example blue or red or orange, blue would allow the light to be experienced by a viewer as a more standard, daytime skylight appearance whilst red or orange would create a sunrise or sunset appearance.

Figure 2:
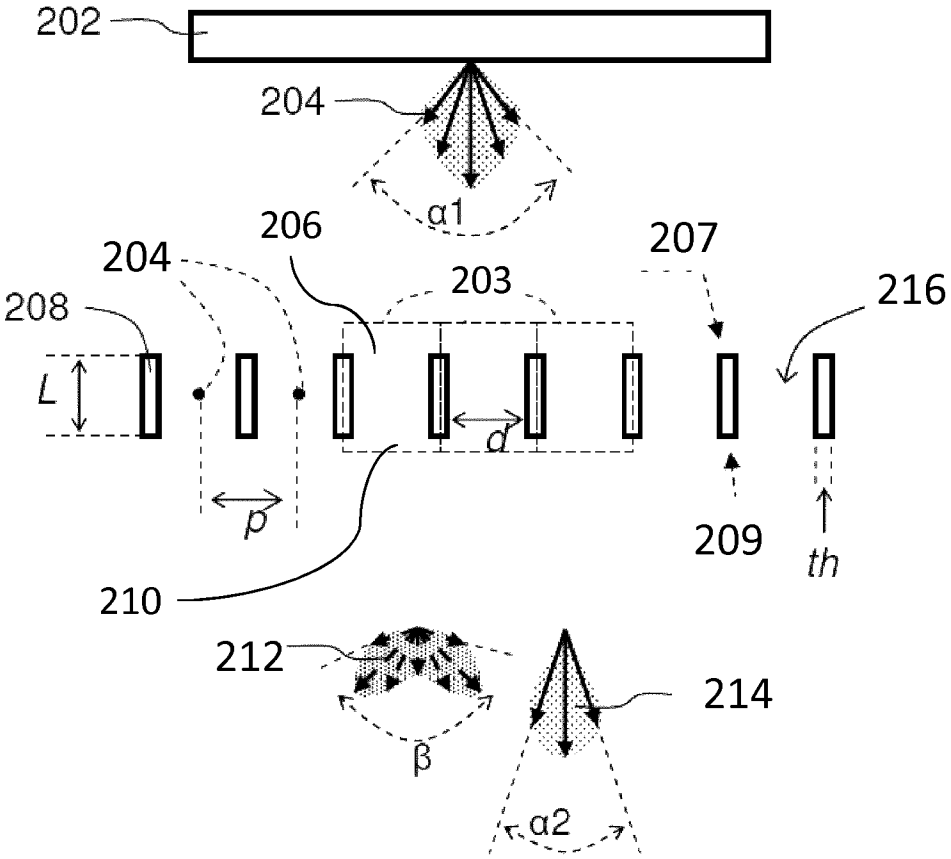

FIG. 2 schematically presents a cross-section of an optical element comprising a plurality of light transmitting cells 203. The plurality of light transmitting cells 203 share walls 208 and light transmitting channels 216 are present between the shared walls 208. Each one of the light transmitting cells 203 operates in the same way as the optical elements of FIG. 1. The optical element comprises a raster layer with the plurality of cells and this may be placed in front of a flat light source 202 which emits light 204 in a specific angular light emission distribution having a Full Width Half Maximum (FWHM) angle $\alpha_1$. The light transmitting cells 203 collimate a part of the light 204 that is received from the flat light source 202 towards a collimated light beam 214 which has a FWHM angle of $\alpha_2$. It is to be noted that $\alpha_2<\alpha_1$. Further, the optical element emits colored light 212 at relatively large light emission angles. The angular light emission distribution of the colored light 212 may have relatively low amounts of light at small light emission angles, and the angular light emission distribution has a maximum light emission $\beta$. It is to be noted that $\beta>\alpha_1$. Light that is a combination of the collimate light beam 214 and the colored light 212 at large light emission angles is experienced as pleasant artificial skylight.

Each light transmitting channel 216 has a length L, which is the shortest distance from the light input window 206 to the light output window 210 along the wall 208. The light transmitting channel 216 has a diameter d which is an average diameter of the light transmitting channel 216 measured in an imaginary plane being parallel to the light input window 206. The ratio between the diameter d and the length L is larger than 0.2 to obtain a certain collimation of the light 204 received from the light source 202 and to obtain a certain amount of colored light 212 at relatively large light emission angles. Especially, the amount of light emitted at light emission angles larger than 60 degrees should be limited to prevent too much glare (for example, less than 1000 nits or candela per square meter). If the ratio is larger than 0.2, which means that the light transmitting channel is relatively flat, not too much light impinges at the walls and as a consequence not too much light is transmitted through the light transmitting cell walls and then emitted through the light exit window at angles larger than 60 degrees, or even at smaller light emission angles, for example, 30 degrees. It is to be noted that the light emission at relatively large light emission angles also depends on the characteristics of the light source. If the light source emits only a minor amount of light at relatively large light emission angles, not much light falls on the walls. If the light source emits a substantial amount of its emitted light at relatively large light emission angles, the walls will transmit, in relative terms, much more light. Thus, the ratio should also be adapted to the characteristics of the light source.

In yet another embodiment, a ratio between a diameter of the light transmitting channel and a length of the light transmitting channel is larger than 0.5. In a further embodiment the ratio is larger than 1.0.

In an embodiment, the ratio between a longest linear distance of the light transmitting channel and a height of the light transmitting channel is larger than 1.0.

The plurality of light transmitting cells 203 are placed with respect to each other at a certain pitch p. The pitch p is defined as the shortest distance from a center point 204 of a light transmitting cell 203 to a center point 204 of a neighboring light transmitting cell 203. The walls 208 have a certain thickness th. The thickness th of a wall 208 is defined as the shortest distance from a surface of the wall 208, which is facing towards a specific light transmitting channel 216, towards another surface of the wall 208, which is facing towards a neighboring light transmitting channel 216. The thickness th of the walls 208 should be smaller than ⅓ of the pitch p of the raster structure in which the plurality of light transmitting cells 203 are placed. The thickness th of the walls 208 have to be limited because the walls 208 contribute to an inefficiency of the optical element, because light 204 of the light source 202, which impinges on an edge 207 of the wall 208 that is facing towards the light source 202, is not transmitted through the optical element. Further, another edge 209 of the walls 208 that is facing towards viewer is seen by the viewer and disturbs the skylight appearance created by the optical element.

In an embodiment, the thickness th of the walls 208 is smaller than ⅙ of the pitch p of the raster structure. In yet another embodiment, the thickness th of the walls 208 is smaller than ⅕ of the pitch p of the raster structure.

In an embodiment, the edge 207 of the wall 208 that is facing towards the light source 202 is reflective or white diffusely reflective. This light is than reflected back to the light source 202 and may be recycled in the sense that the light source 202 may reflect the light back to the optical element.

Figure 3A:
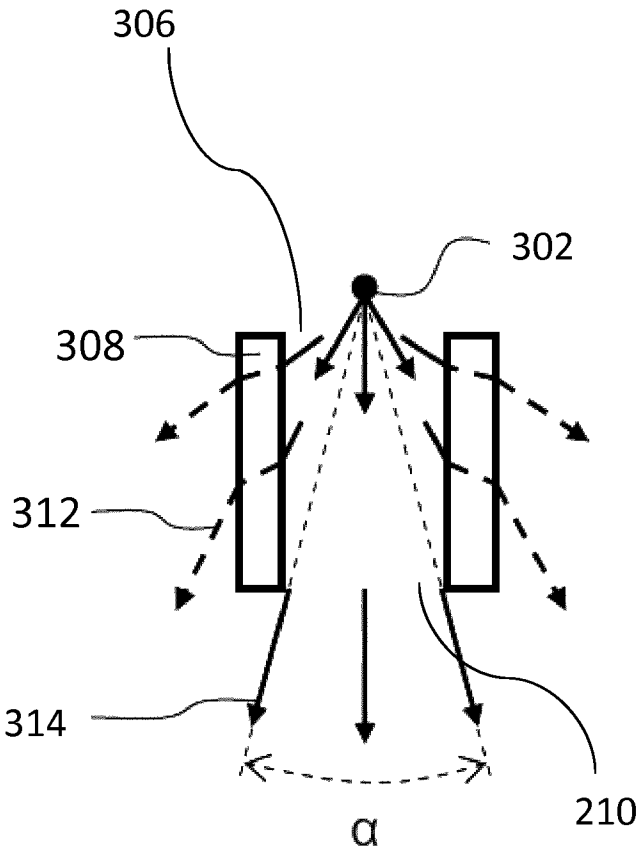

FIG. 3*a* schematically presents a cross-section of a light transmitting cell within the optical element. The light source 302, depicted as a point source, emits substantially white light into the light transmitting cells. Light with light emission angles within the depicted angle α is transmitted through the light transmitting cells without being disturbed. Light from the light source 302 outside the angle α impinges on the colored transparent wall 308 and is transmitted through the wall which absorbed color components complementary to the color of the wall 308. The light 312 has an enhanced color component, which means that the light 312 has a more saturated color than the light which is received from the light source 302. Thus, in line with previous embodiments, the optical element emits white light 314 at relatively small light emission angles, and emits colored light 312 at relatively large light emission angles, and thus is a skylight appearance created.

It is to be noted that a part of the light exit window is opposite the light input window, and a part of the light exit window is formed by the transparent walls 308. Through the part opposite the light input window is transmitted the light 314 that directly originates from the light source, and through the part of the light exit window that is formed by the transparent walls 308 the colored light 312 is transmitted. However, the light emitted through the light exit window at relatively large light emission angles will be colored. Further, if in an optical element like the optical element of FIG. 2 all walls would be light transmissive in a predefined spectral range, each light exit window also emits colored light (which is received via the walls of a neighboring cell). Also in this situation the colored light is mainly emitted at relatively large light emission angles.

Figure 3B:
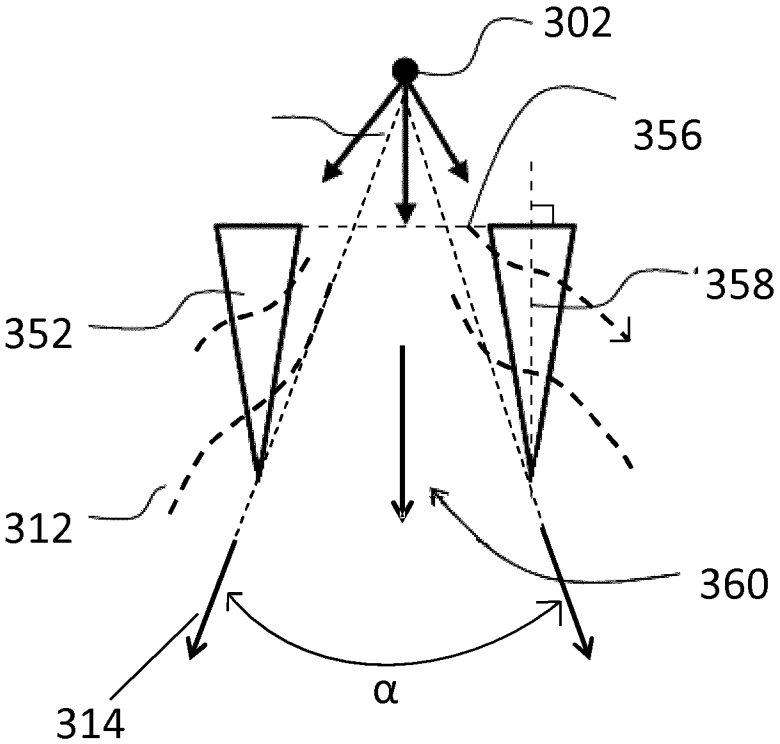

FIG. 3*b* schematically shows another embodiment of a light transmitting cell within the optical element. The walls 352 of the light transmitting cell of the optical element taper in a direction from the light input window 356 towards the light exit window 360. This may be advantageous because the view does not see an edge of the walls 352 when viewing towards the optical element. Further, as also shown in other embodiments, the central line 358 of the walls 352 is substantially perpendicular to the light input window 356. At another side of the light transmitting cell is a light exit window 360 which is substantially parallel to the light input window 356.

Figure 4A:
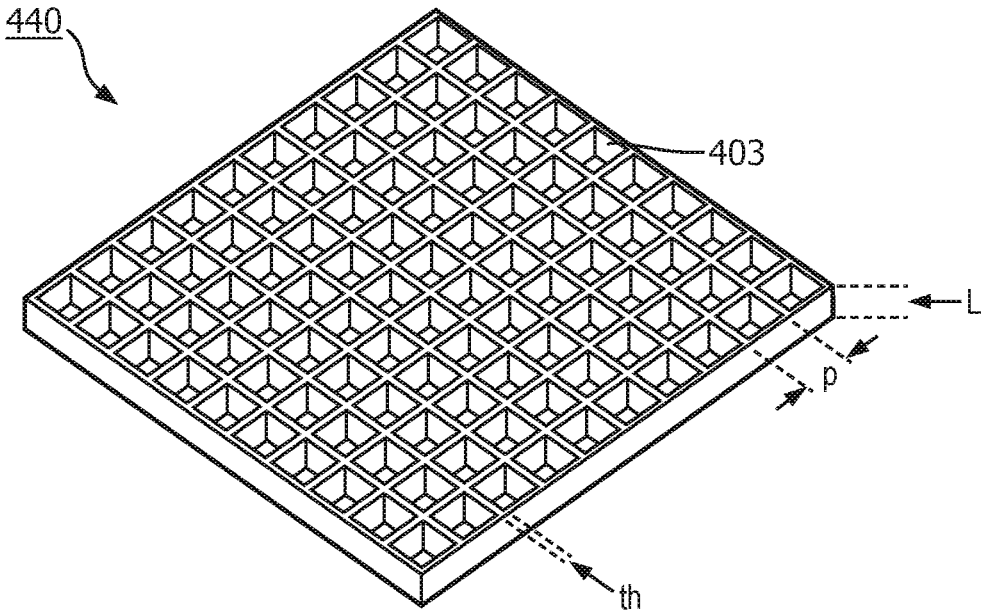

FIG. 4*a* schematically shows an embodiment of the raster structure comprising a plurality of light transmitting cells 403. A shape of a cross-section of the light transmitting cells 403 is square. Further, the walls of the light transmitting cells 403 are transmissive in a predefined spectral range and may be made of a synthetic material. The raster structure 440 may be manufactured with an injection molding process. Previously discussed parameters of the light transmitting cells 403, like the pitch p, the thickness th of the walls and the length L of the light transmitting channels are indicated as well.

It is to be noted that the walls of the light transmitting cells within the raster structure 440 are transparent. Thus, the viewer sees a more dark color at larger viewing angles (defined with respect to a normal to a part of light exit window that is opposite the light input window) because light rays at these angles are transmitted through a plurality of successive walls, at each wall the color is intensified.

Figure 4B:
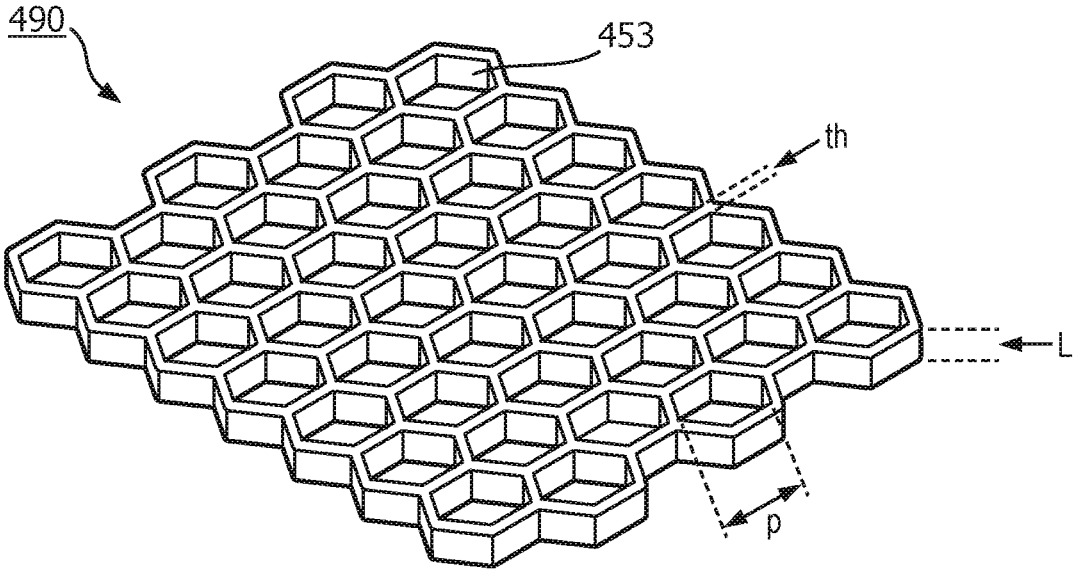

FIG. 4*b* schematically shows another embodiment of the raster structure comprising a plurality of light transmitting cells 453. A shape of a cross-section of the light transmitting cells 453 is hexagonal. Further, the walls of the light transmitting cells 453 are colored and may be made of a synthetic material. The raster structure 490 may be manufactured with an injection molding process. Previously discussed parameters of the raster structure 490 and the light transmitting cells 453, like the pitch p, the thickness th of the walls and the length L of the light transmitting channels are indicated as well.

Figure 4C:
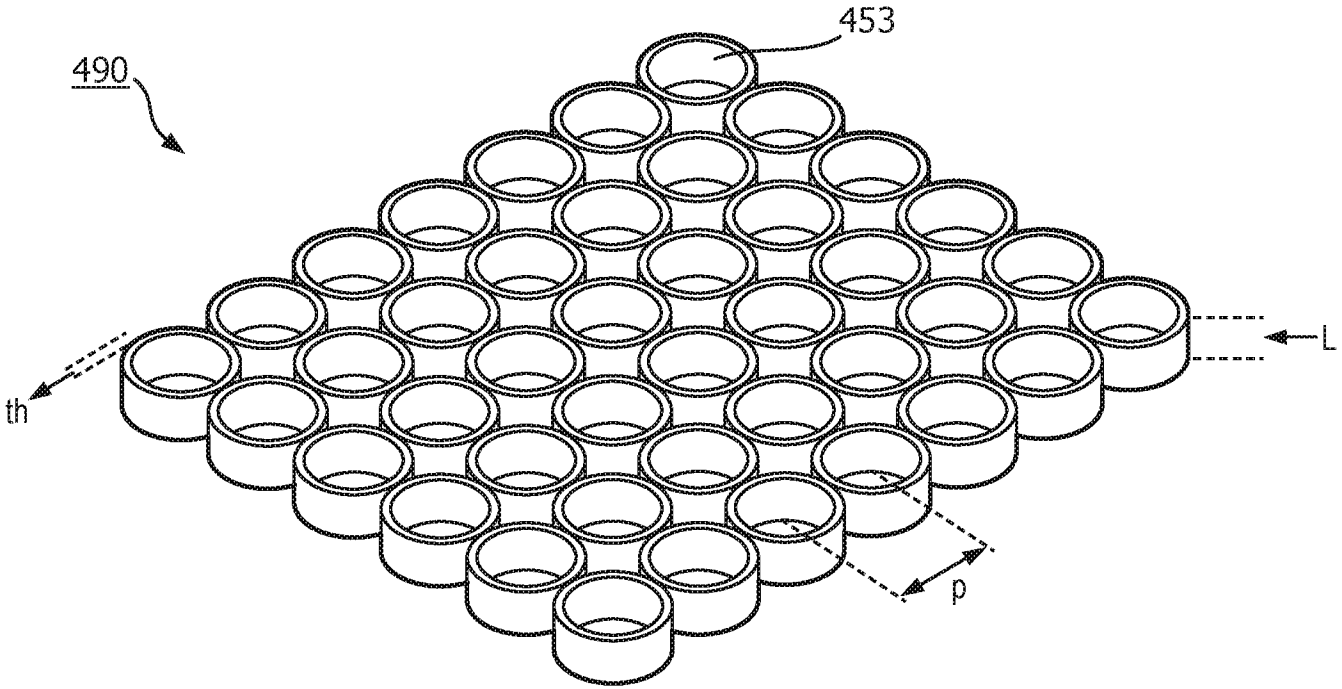

FIG. 4*c* schematically shows a preferred embodiment of the raster structure comprising a plurality of light transmitting cells 453. A shape of a cross-section of the light transmitting cells 453 is circular. Further, the walls of the light transmitting cells 453 are colored and may be made of a synthetic material. The raster structure 490 may be manufactured with an injection molding process. Previously discussed parameters of the raster structure 490 and the light transmitting cells 453, like the pitch p, the thickness th of the walls and the length L of the light transmitting channels are indicated as well.

In another embodiment (not shown), the walls have a color gradient, for example from white close to the light input window to colored at the light exit window. This creates a smooth transition towards more saturated colors when the viewer looks towards the optical element at larger viewing angles.

Figure 5:
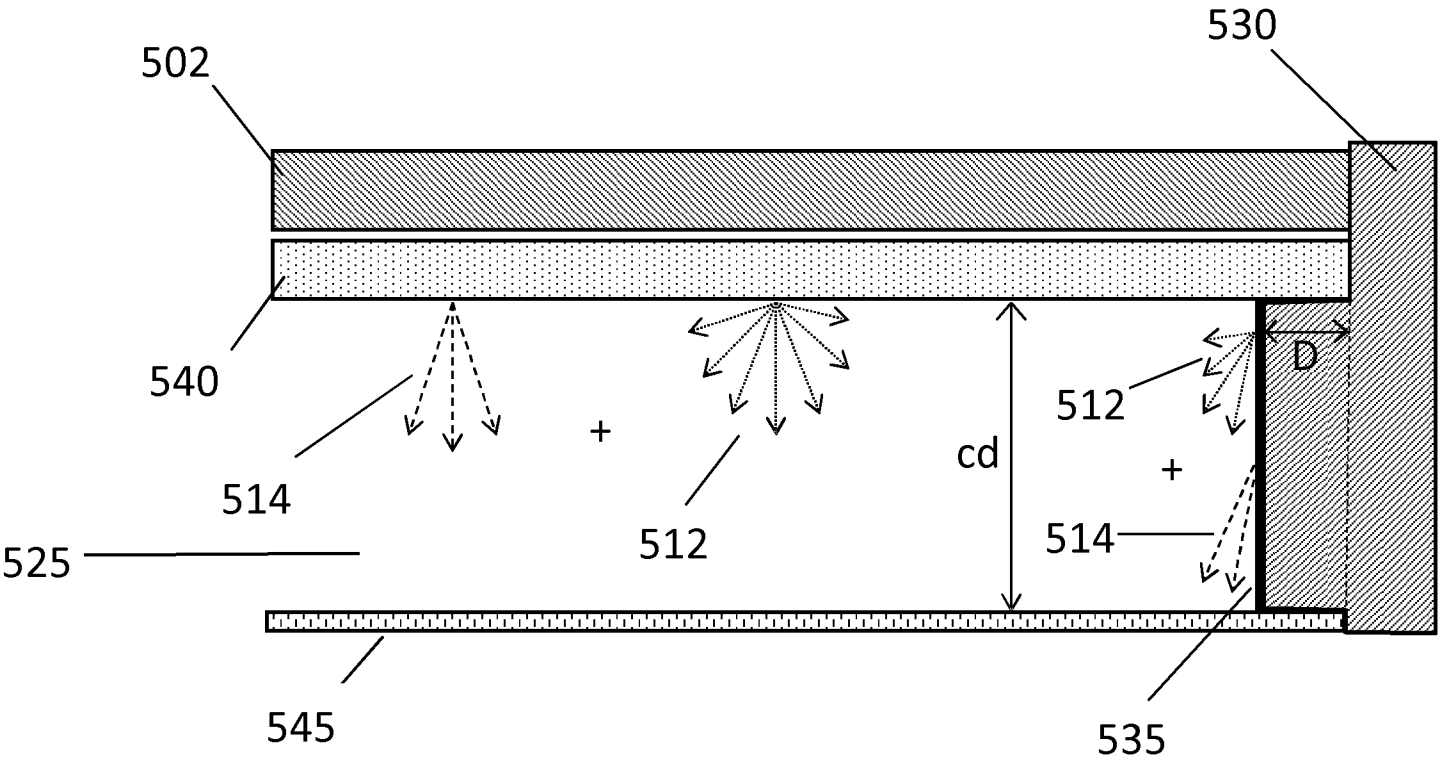

FIG. 5 schematically shows another embodiment of the optical element comprising a plurality of light transmitting cells in a raster structure 540, a diffuser 545 and an edge wall 530. The light source 502 emits light towards the raster structure 540. Collimated light 514 with the same color as the light source and light 512 that is transmitted through the side walls of the plurality of light transmitting cells exits the raster structure 540 through the light exit windows of the light transmitting cells.

The white light 514 and the colored light 512 that is transmitted by the raster structure 540 may impinge upon the side wall 530 of the optical element. It can be seen that the portion of the side wall 530 that is interposed between the raster element 540 and the diffuser 545 extends inwards into the chamber 525 that is formed by the cooperation of the raster structure 540, the diffuser 545 and the edge wall 530. This extended portion of the edge wall is a region of specular reflectivity 535 and will reflect the light that impinges upon it back into the chamber 525.

The distance of the edge wall extension D is possible within a range of 0.5 to 5 times the pitch of the light transmitting cells. The relationship between the pitch of the light transmitting cells and D is important because it allows the specularly reflective region 535 of the edge wall 530 to be placed at a plane of symmetry that is perpendicular to the raster structure 540. This concept will be more fully explained below in FIGS. 6*a-c*.

Light exits the optical element through the diffuser 545, the weak diffusion of the diffusing layer 545 is advantageous to obtain a light emission distribution which has a smooth transition between light 514 which directly originates from the light source 502 and the colored light 512 that is transmitted through the walls of the light transmitting cells.

Figure 6:
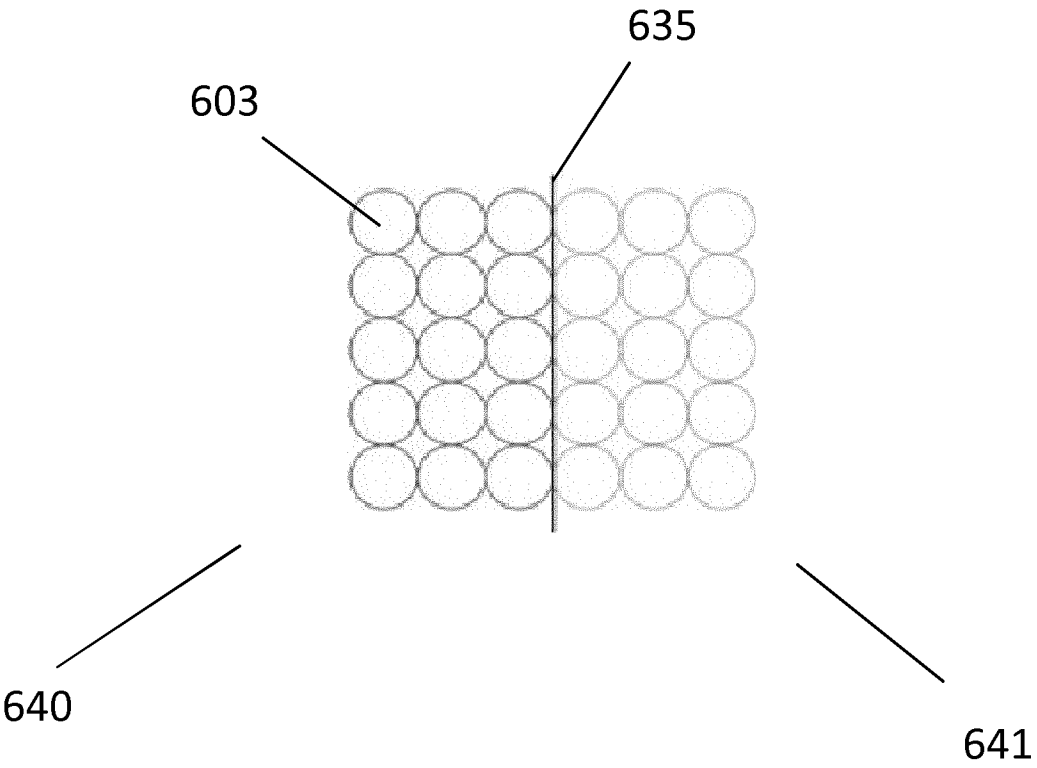

FIG. 6 schematically shows a cross section of the raster structure along a plane parallel to the light input windows of the light transmitting cells 603. The specularly reflective region 635 of the edge wall is positioned adjacent to a row of light transmitting cells 603. The positioning of the specularly reflective region 635 is such that if the optical element is viewed at a large viewing angle, the raster structure 640 appears to continue in the specularly reflective region 635 without any apparent breaks in density, thus giving a mirror image 641 of the raster structure 640.

Figure 7:
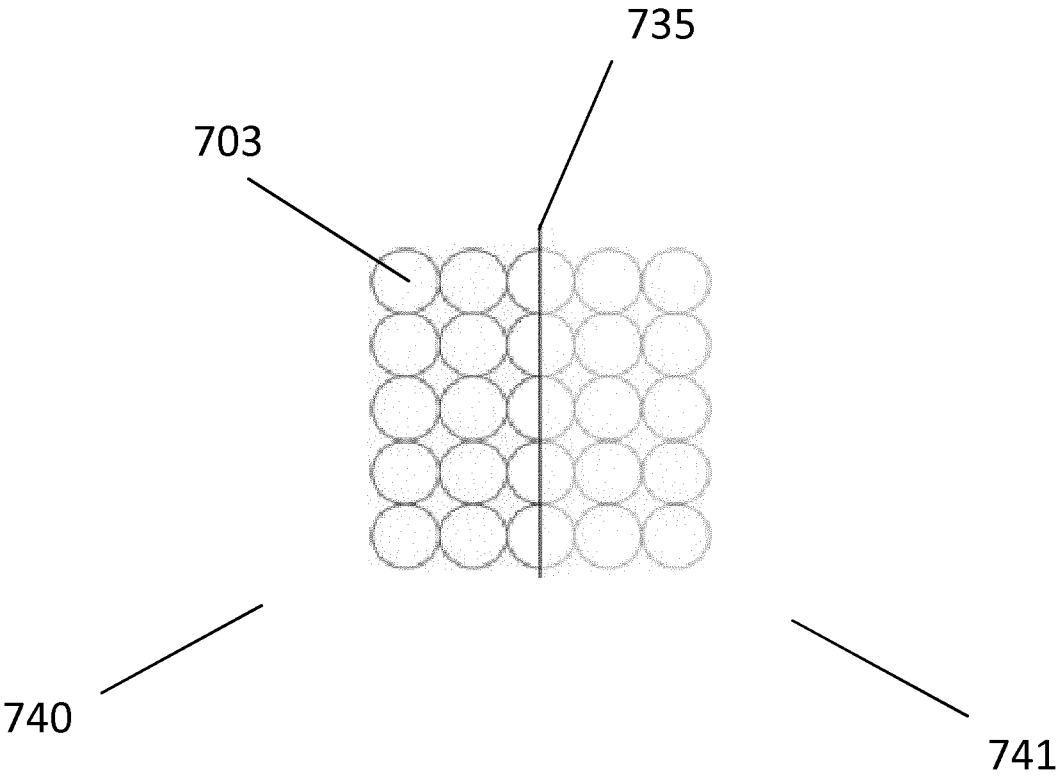
FIG. 7 schematically shows a cross section along a plane parallel to the light input windows of the light transmitting cells. The edge wall is shown as a black line and is positioned such that it passes through the center of a row of light transmitting cells and so forms a mirror image and thus creates an apparently continuous raster structure.

FIG. 7 schematically shows a cross section of the raster structure along a plane parallel to the light input windows of the light transmitting cells 703. The specularly reflective portion 735 of the edge wall is positioned such that it passes through the center of a row of adjacent light transmitting cells 703. The positioning of the specularly reflective region 735 is such that if the optical element is viewed at a large viewing angle, the raster structure 740 appears to continue in the specularly reflective region 735 without any apparent breaks in density, thus giving a mirror image 741 of the raster structure 740.

Figure 8:
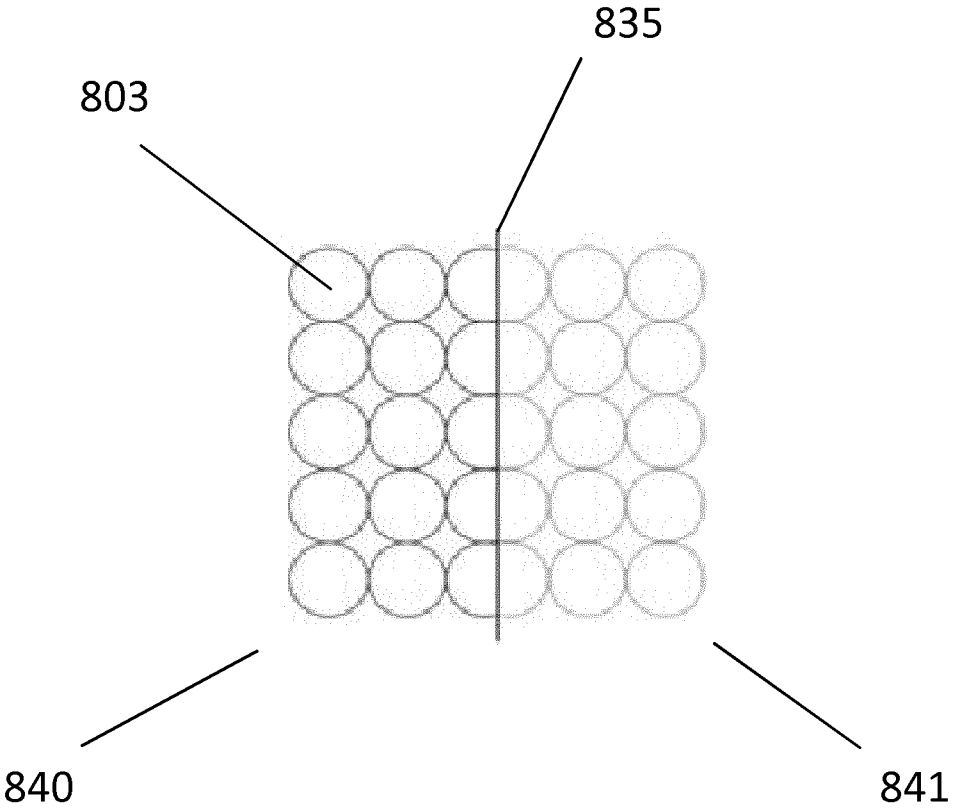
FIG. 8 schematically shows a cross section along a plane parallel to the light input windows of the light transmitting cells. The edge wall is shown as a black line and is positioned such that it passes through a row of adjacent light transmitting cells, however it does not pass through the center of the row of light transmitting cells and so the mirror image formed creates a discontinuity in the raster structure, and FIG. 9 schematically shows a luminaire according to a second aspect of the invention.

FIG. 8 schematically shows a cross section of the raster structure along a plane parallel to the light input windows of the light transmitting cells 803. The specularly reflective region 835 of the edge wall is positioned such that it passes through a row of adjacent light transmitting cells 803, however it does not pass through the center of the row of adjacent light transmitting cells. When the optical element 840 is viewed at a large viewing angle, the raster structure 840 appears to continue in the specularly reflective region 835. However there is an apparent break in density and where the raster structure 840 and the mirror image 841 meet there is a visual discontinuity. This is to be avoided as it impairs the appearance of the optical structure.

Figure 9:
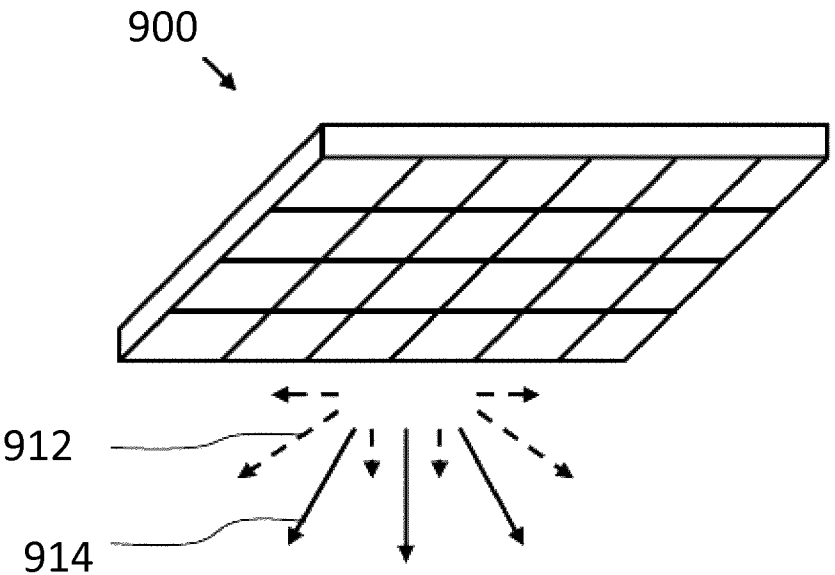

FIG. 9 schematically shows an embodiment of a luminaire 900 according to the second aspect of the invention. The luminaire 900 comprises an optical element according to one of the previous embodiments. The optical element is schematically shown in FIG. 9 with the raster structure at the light emitting surface of the luminaire 900. The luminaire further comprises a flat light source which emits light along a relatively large surface.

In an embodiment, the light transmitting channel is transparent. The light transmitting channel may be filled with air, or another transparent material such as glass or a transparent synthetic material. In yet a further embodiment, the light transmitting channel is a fully enclosed space which is filled with a clear fluid.

In another embodiment, the raster structure is a stretched-out stack of elongated layers. Pairs of successive layers are joined together at a plurality of points. Successive pairs of successive layers are joined together at different points. The layers form the walls of the light transmitting channels, and the light transmitting channels are formed by spaces between two successive layers of the stretched-out stack of elongated layers. The point-wise joining of layers may be carried out by gluing. Such a raster structure may be manufactured very efficiently. Elongated stripes of a colored material are successively glued together such that the glue-points of successive pairs of successive layers are different in a direction following the elongated layer, and after the gluing, the stack of elongated layers is stretched-out to obtain the raster structure. Further, besides the fact that such a structure may be manufactured efficiently, the embodiment may result in further benefits in the distribution and storages of the raster structure. Namely, it is not necessary to stretch out the stack of layers immediately after gluing the layers together. This may also be performed just before the raster structure is arranged in front of a light source or luminaire. Thus, after gluing the layers together, the stack may be stored or distributed in its most compact shape.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. An optical element for use in front of a light source for obtaining a skylight appearance, said optical element having an element light input window and an element light exit window; wherein the optical element comprises a raster structure situated at the element light input window, a diffuser situated at the element light exit window opposite of the raster structure, and an edge wall extending between the raster structure and the diffuser; the raster structure, the diffuser and the edge wall defining a chamber;

wherein the raster structure comprises a plurality of light transmitting cells, each light transmitting cell comprising:

a light transmitting channel for collimating a part of light emitted by the light source, a light input window at a first side of the light transmitting channel for receiving light from the light source, a light exit window for emitting light, at least a part of the light exit window being arranged at a second side of the light transmitting channel opposite to the first side, and a wall interposed between said light input window and said part of the light exit window, the wall enclosing the light transmitting channel, at least a part of the wall being transmissive in a predefined spectral range for obtaining a colored light emission at relatively large light emission angles with respect to a normal to the part of said light exit window; and, a surface of the edge wall arranged perpendicular to the raster structure being specularly reflective for specularly reflecting the light emitted from the raster structure and impinging on said surface of the edge wall towards said diffuser.

2. An optical element according to claim 1 wherein the raster structure is configured to cooperate with a first section of the edge wall and the diffuser is configured to cooperate with a second section of said edge wall; said edge wall having a portion interposed between said raster structure and said diffuser, said portion extending inwards into the chamber of said optical element and comprising said specularly reflective surface.

3. An optical element according to claim 2 wherein the extent of said portion of the edge wall extending inwards into the chamber of said optical element is in the range of 0.5 to 5 times of a pitch of the raster structure, wherein the pitch of the raster structure is defined by the distance from a center point of a light transmitting channel to a center point of a neighboring light transmitting channel.

4. An optical element according to claim 1 wherein the specularly reflective surface is arranged along an imaginary symmetry plane of the raster structure perpendicular to said raster structure.

5. An optical element according to claim 1 wherein the distance between the raster structure and the diffuser is in the range of 1 to 10 times of a pitch of the raster structure, wherein the pitch of the raster structure is defined by the distance from a center point of a light transmitting channel to a center point of a neighboring light transmitting channel.

6. An optical element according to claim 1, wherein a shape of a cross-section of the light transmitting channel along an imaginary plane parallel to the light input window is one of a circle, an ellipse, a triangle, a square, a rectangle, or a hexagon.

7. An optical element according to claim 1, wherein said colored light emission is at least one of a blue, a red and an orange light emission.

8. A luminaire comprising the optical element for obtaining a skylight appearance according to claim 1.

9. A luminaire comprising a light source and the optical element for obtaining a skyline appearance according to claim 1, wherein the light source is configured to emit light towards the element light input window of said optical element.

* * * * *